US006168034B1

(12) United States Patent
Perrone

(10) Patent No.: US 6,168,034 B1
(45) **Date of Patent: *Jan. 2, 2001**

(54) SELF RIGHTING BOTTLE

(76) Inventor: Daniel R. Perrone, 4 Lime Kiln Ct., Wesley Hills, NY (US) 10959

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/059,169

(22) Filed: Apr. 13, 1998

(51) Int. Cl.[7] ..... A61J 9/00

(52) U.S. Cl. ..... 215/11.1; 220/603; 248/910; 248/364

(58) Field of Search ..... 220/603; 248/910, 248/364; 215/11.1

(56) References Cited

U.S. PATENT DOCUMENTS

| | | | | |
|---|---|---|---|---|
| 179,416 | * | 7/1876 | Kennish | 215/11.1 |
| 434,423 | * | 8/1890 | Burrows | 220/603 |
| 1,559,234 | * | 10/1925 | Fleming | 248/910 X |
| 1,690,311 | * | 11/1928 | Reich | 248/910 X |
| 1,704,248 | * | 3/1929 | Heilbrun | 248/910 X |
| 2,601,767 | | 7/1952 | Wall . | |
| 2,767,563 | | 10/1956 | Picascia . | |
| 2,937,872 | | 5/1960 | Gizman . | |
| 3,323,798 | | 6/1967 | Miller . | |
| 3,661,288 | * | 5/1972 | Noll | 215/11.1 |
| 3,699,913 | | 10/1972 | Sautbine . | |
| 4,096,966 | | 6/1978 | Korshak . | |
| 4,121,731 | | 10/1978 | Okerstrum . | |
| 4,127,211 | | 11/1978 | Zerbey . | |
| 4,146,157 | | 3/1979 | Dixon . | |
| 4,303,170 | | 12/1981 | Panicci . | |
| 4,388,996 | | 6/1983 | Panicci . | |
| 4,944,704 | * | 7/1990 | Grace | 215/11.1 X |
| 4,953,737 | | 9/1990 | Meyers . | |
| 5,150,800 | * | 9/1992 | Sarter et al. | 215/11.1 X |
| 5,294,018 | * | 3/1994 | Boucher | 220/603 |
| 5,322,031 | * | 6/1994 | Lerner et al. | 215/11.1 X |

* cited by examiner

*Primary Examiner*—Allan N. Shoap
*Assistant Examiner*—Tri M. Mai
(74) *Attorney, Agent, or Firm*—Colbrin & Gittes

(57) ABSTRACT

A self righting bottle or combination bottle and holder that prevents leakages otherwise resulting in drips, spills, and stains on floors, floor coverings and carpets, particularly permanent stains on various floor coverings. Preferably, it keeps the nipple clean by avoiding such leakages for prolonged periods, thereby preventing nipple contamination by other substances proximate to the nipple end of the bottle. The self righting bottle includes a container with at least one sidewall, a weighted bottom having an outwardly facing convex surface, the bottom having a center of mass situated so that, in cooperation with the convex surface, the bottle self rights itself into an upright position from a prone position after being tipped on a level surface into the prone position. The self righting bottle may be configured or molded as a clown, cartoon or face character.

3 Claims, 3 Drawing Sheets

SELF RIGHTING BOTTLE

BACKGROUND OF THE INVENTION

1. Field of the Invention

The present invention generally relates to self righting bottles. These bottles resist tipping, are self righting, and thereby, avoid leaking from a sideways position through the cap or nipple of the bottle.

2. Discussion of Related Art

When toddler or infant formula bottles lie sideways, leakage may occur from the end cap or nipple portion of the bottle or both. Leakage of the contents of the bottle can create sticky areas. If the contents are relatively expensive as is the case with formula or dietary liquid supplements for children's diets, such leakage is particularly wasteful.

3. During the course of a child's day-to-day activities, it is likely that a bottle will be tossed sideways, pushed or even intentionally shoved away. An adult monitoring the child's intake of liquid will be unable to rectify and upright the bottle fast enough before leakage occurs. Considering that this may occur throughout the day, the quantity of the contents lost to leakage adds up. As a result, the person monitoring the liquid intake of the child approximates the amount of spillage and deducts that amount from the total intake. Preferably, the bottle should resist tipping and spillage to enable precise measuring of liquid intake and obviate the necessity to guess at approximate leakages.

U.S. Pat. Nos. 2,601,767; 4,303,170; 4,388,996; 4,953,737; 5,294,918 among others disclose various forms of self righting drinking cups. In particular, U.S. Pat. No. 4,096,996 teaches a self righting drinking cup having a removable base so that the cup may be separately used in the conventional fashion. The base is adapted to engage the cup to form a push or screw fit. U.S. Pat. No. 5,294,018 teaches a self righting drinking cup with a weighted base, a removable lid, a drinking spout and a separate vent hole. While U.S. Pat. No. 4,953,737 discloses a self righting vessel which does not require a weighted base, it mentions that ballast was used to achieve a self righting cup.

SUMMARY OF THE INVENTION

One aspect of the present invention resides in a self, righting bottle or combination bottle and holder that prevents leakages otherwise resulting in drips, spills, and stains on floors, floor coverings and carpets, particularly permanent stains on various floor coverings. Preferably, the invention keeps the nipple clean by avoiding such leakages for prolonged periods, thereby preventing nipple contamination by other substances proximate to the nipple end of the bottle.

The self righting bottle includes a container with at least one sidewall, a weighted bottom having an outwardly facing convex surface, the bottom having a center of mass situated so that, in cooperation with the convex surface, the bottle self rights itself into an upright position from a prone position after being tipped on a level surface into the prone position.

The self righting bottle may be configured, molded or accessorized as a clown, face or cartoon character.

For a better understanding of the present invention, reference is made to the following description and accompanying drawings, while the scope of the invention is set forth in the appended claims.

DESCRIPTION OF THE PREFERRED EMBODIMENTS

Figure 1:
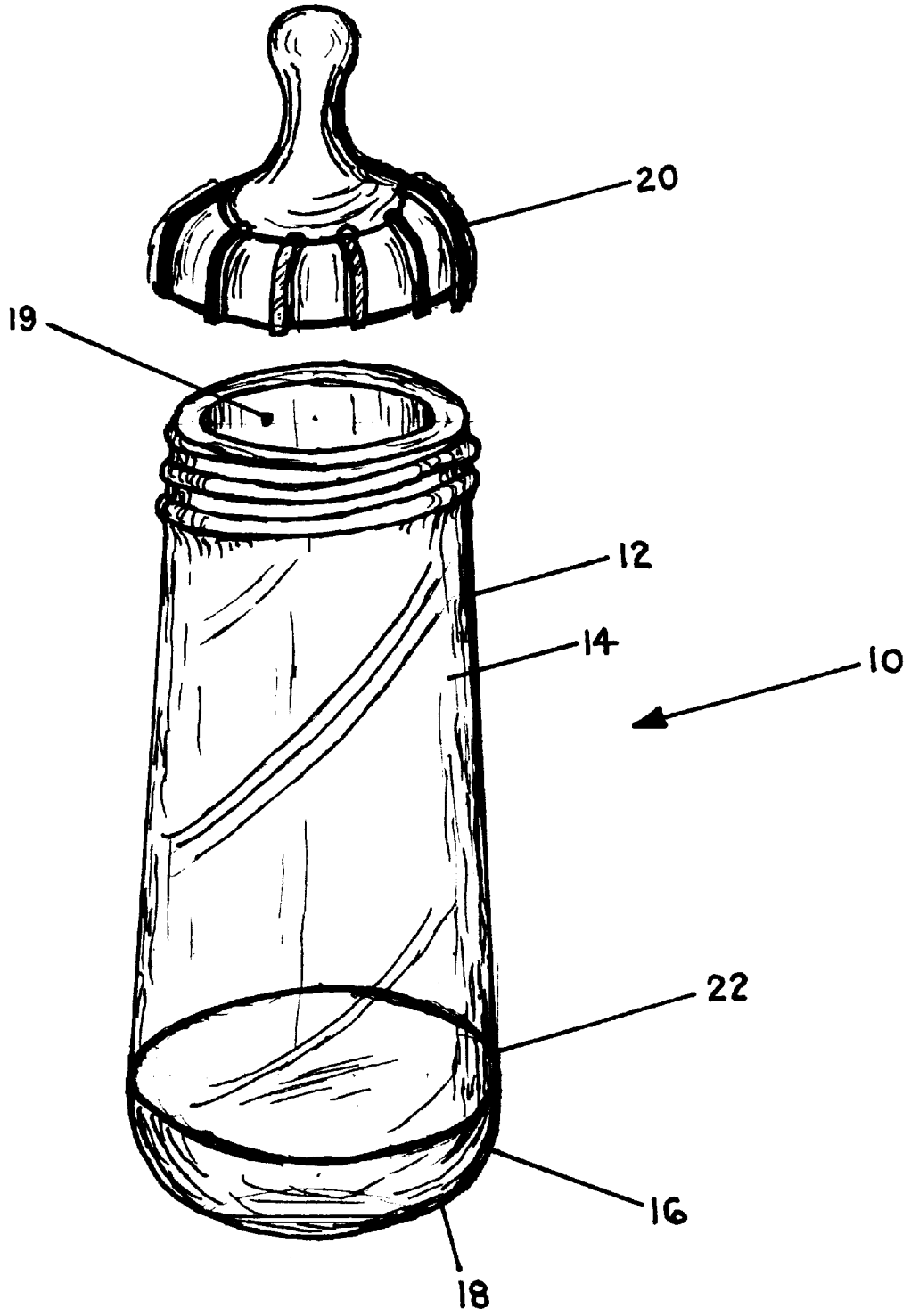
FIG. 1 is an exploded elevation plan view of a first embodiment of the self righting bottle.

According to a first embodiment of FIG. 1, a self righting bottle 10 comprises a base container 12 having an elongated sidewall 14 and a weighted bottom 16 secured to the base of the sidewall 14. The weighted bottom 16 has a convex exterior surface 18 that progressively decreases in diameter in a direction distal from the sidewall base.

The weighted bottom 16 may be filled with a ballast material or may be solidly constructed to provide the weighted bottom portion 16 with sufficient weight to resist tipping and allow the bottle to upright itself even when the bottle is filled with liquid. The open end of the bottle is capable of receiving a cap and/or nipple 20, thereby allowing the user to switch between any one of a series of nipples by simply changing caps to conform to the desired nipple. It is conceivable, however, that the same cap can be used with any one of several different types of nipples.

The weighted bottom 16 of the bottle may be constructed of a solid, rigid plastic material, such as ABS plastic, or, alternatively, the weighted bottom portion 16 may contain a cavity filled with ballast of sufficient weight to resist tipping and to enable the bottle to upright itself. Ballast materials, may include, but are not limited to sand and metal beads.

It is desirable that the bottle have a capacity to retain at least six fluid ounces when filled.

The bottle as shown in FIG. 1 has a center of mass that lies on a longitudinal axis of the container 12. This axis extends along a geometric center of the bottle. The center of mass is situated between a distal region of the convex exterior surface 16 and a plane passing through a juncture 22 or transition region.

Figure 2:
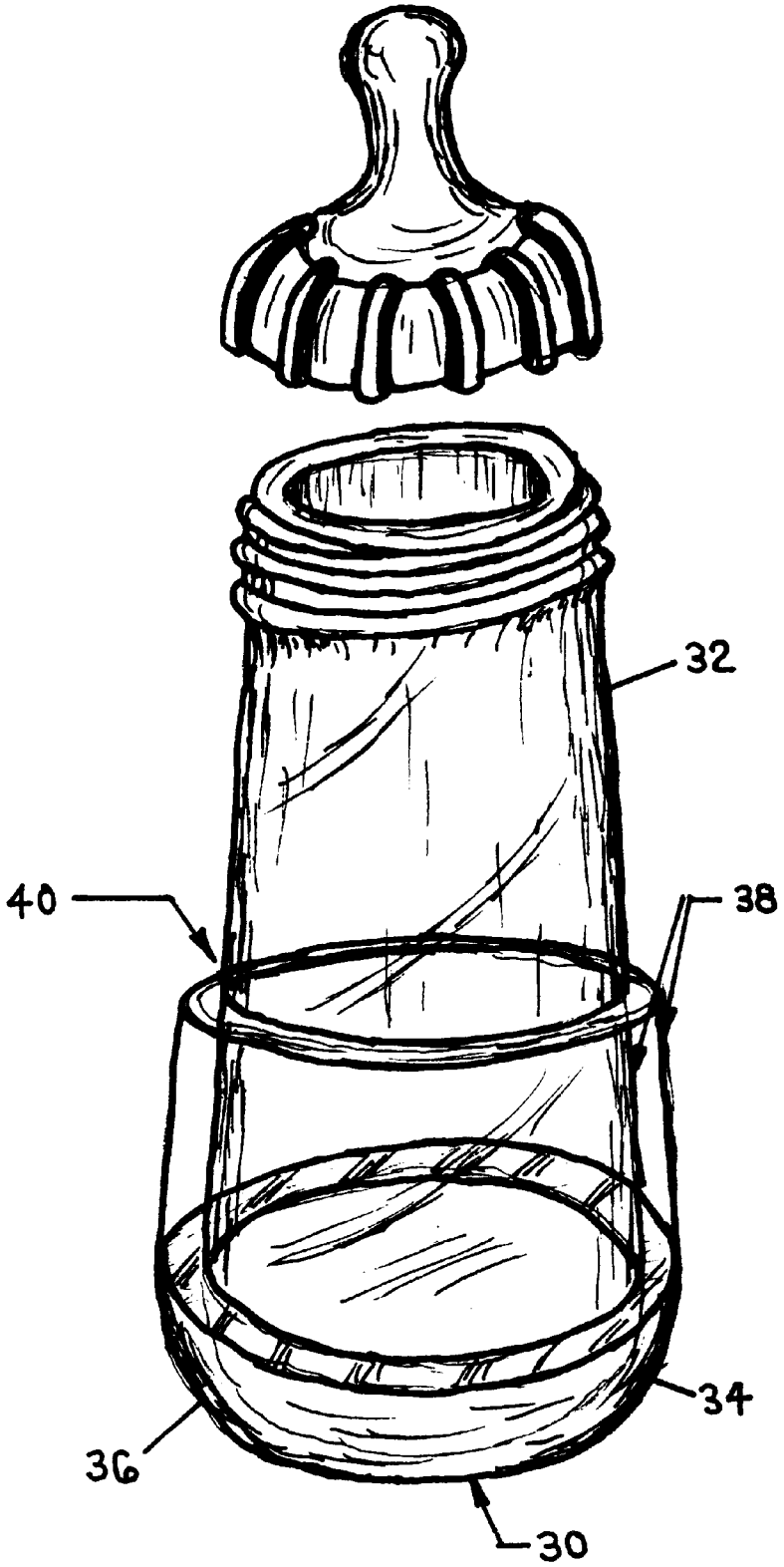
FIG. 2 is an exploded elevation plan view of a second embodiment of the self righting bottle.

FIG. 2 shows a second embodiment of the invention using a bottle holder 30 that is separate from the bottle 32 and that has a bottom portion 34 with a convex exterior surface 36. In use, the bottle is placed in the holder 30, which resists tipping and uprights the bottle and itself, from a prone position after being tipped on a level surface into a prone position.

The holder 30 has a flexible, resilient wall 38 defining a recess 40 for accepting the bottle 32. The bottle must fit snugly in the recess 40. Also, the wall 38 must grasp the bottle sufficiently to prevent the bottle from easily falling on its side and out of the holder. The ballast materials comprising the holder are the same as that described with respect to the weighted bottom of the first embodiment.

The bottle 32 is removed from the holder 30 by pulling the bottle out of the holder with sufficient force to overcome the grasping force exerted against the bottle by the resilient wall 38 of the holder. During bottle removal, the holder 30 must be immobilized sufficiently to enable the bottle 32 to separate from the holder 30 in response to the pulling force. The immobilization may be done manually. During bottle insertion, manual pushing forces are exerted on the bottle 32 to force the bottle into the recess 40 of the holder, while the holder rests immobilized on a level surface or is held. This insertion enables the bottle to be grasped and secured by the wall of the holder.

Although the embodiment of FIG. 1 shows the bottle as being conical and the embodiment of FIG. 2 shows the bottle 32 as cylindrical and the holder 30 as being truncated-conical, the bottle and holder shapes may be any shape, such as having an octagonal cross-section instead of a round cross-section.

Figure 3:
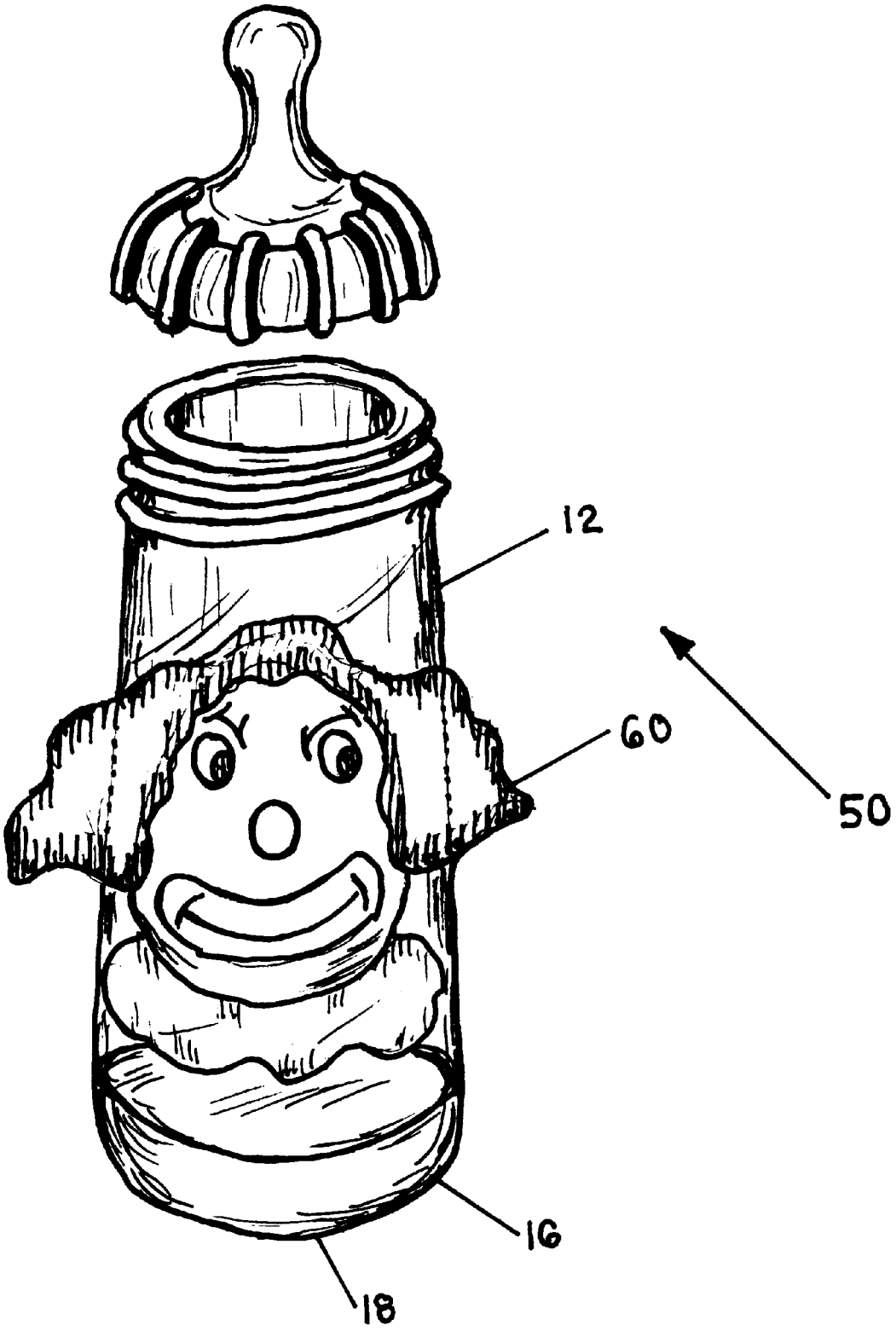
FIG. 3 is an exploded elevation plan view of a third embodiment of the self righting bottle.

FIG. 3 shows the self righting bottle 50 configured with a clown character 60. The self righting bottle can also be configured or molded into other character figures and optionally painted or accessorized.

While the foregoing description and drawings represent the preferred embodiments of the present invention, it will be understood that various changes and modifications may be made without departing from the spirit and scope of the present invention.

What is claimed is:

1. A method of using a nursing bottle, comprising the steps of:

providing a nursing bottle with an elongated sidewall and a base end and an open mouth end, the elongated sidewall having a neck that is smaller in diameter than the open mouth end;

adding weight to the base end with a weighted bottom that has a center of mass, the weighted bottom having a convex outer surface that progressively decreases in diameter in a direction increasingly distal from said a distal end of said sidewall;

containing fluid contents within the nursing bottle;

closing the open mouth end with an end cap, securing a nipple to the mouth end with the end cap, the nipple being configured to be susceptible to leakage when the nursing bottle is in a prone position;

tipping the nursing bottle on a level surface from an upright position to the prone position by exerting tipping forces; and self-righting the bottle from the prone position to the upright position to prevent the leakage of the fluid contents through the nipple of the nursing bottle when the nursing bottle is in the prone position, the self-righting arising in response to removal of the tipping forces and from the center of mass of the weighted bottom being situated to cooperate with the convex outer surface tending to force the nursing bottle to change position from the prone position to the upright position providing the elongated sidewall of the nursing bottle with a configuration that progressively decreases in diameter from the base end thereby converging in a direction increasingly distal from said convex outer surface of said weighted bottom.

2. A method as in claim 1, further comprising configuring the nursing bottle to have a resemblance any one of a face, clown and cartoon character.

3. A method as in claim 1, further comprising the step of switching between any one of a series of nipples by removing the cap from the open mouth end and exchanging the nipple with a desired one of the series of nipples and then securing the desired one of the series of nipples to the open mouth end with the cap.

* * * * *